US008904833B1

(12) United States Patent
Liu

(10) Patent No.: US 8,904,833 B1
(45) Date of Patent: Dec. 9, 2014

(54) LOCK WITH REPLACEABLE SHACKLE

(71) Applicant: Federal Lock Co., Ltd., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 13/947,234

(22) Filed: Jul. 22, 2013

(51) Int. Cl.
*E05B 67/22* (2006.01)
*E05B 67/06* (2006.01)

(52) U.S. Cl.
CPC ..... *E05B 67/063* (2013.01)
USPC ..... 70/38 A; 70/38 C; 70/368; 70/371; 70/39

(58) Field of Classification Search
USPC ..... 70/368, 370, 371, 382, 384, 367, 35, 70/38, 39, 38 A, 38 B, 38 C
See application file for complete search history.

(56) References Cited

U.S. PATENT DOCUMENTS 957,033 A * 5/1910 Bruycker ..... 70/38 A
1,844,569 A * 2/1932 Fairchild ..... 70/38 C
1,849,070 A * 3/1932 Buehner ..... 70/38 C
2,460,615 A * 2/1949 Andrew ..... 70/369
2,691,288 A * 10/1954 Childs ..... 70/38 A
3,835,675 A * 9/1974 Lippisch ..... 70/38 A
3,855,824 A * 12/1974 Falk ..... 70/38 A
3,952,565 A * 4/1976 Falk ..... 70/417
4,138,868 A * 2/1979 Richards, Sr. ..... 70/38 A
4,241,594 A * 12/1980 Miller et al. ..... 70/38 A
4,290,279 A * 9/1981 Fish et al. ..... 70/38 A
4,404,825 A * 9/1983 Dixon et al. ..... 70/368
4,528,828 A * 7/1985 Poutiainen ..... 70/38 A
4,776,187 A * 10/1988 Evans et al. ..... 70/38 A
4,838,051 A * 6/1989 Yang ..... 70/38 A
5,079,935 A * 1/1992 Zaucha ..... 70/140
5,121,619 A * 6/1992 Martin ..... 70/371
5,325,690 A * 7/1994 Adler et al. ..... 70/383
5,511,400 A * 4/1996 Ma ..... 70/38 R
5,720,191 A * 2/1998 Tsung-Chuan et al. ..... 70/38 A
5,896,761 A * 4/1999 Chen ..... 70/38 A
6,101,852 A * 8/2000 Steinbach ..... 70/38 A
6,766,673 B2 * 7/2004 Gast et al. ..... 70/38 A
6,769,277 B1 * 8/2004 Chang ..... 70/52
6,813,913 B2 * 11/2004 Watts ..... 70/38 A
7,013,686 B1 * 3/2006 Chen ..... 70/43
7,036,344 B2 * 5/2006 Gast et al. ..... 70/38 A
7,234,331 B2 * 6/2007 Armstrong et al. ..... 70/492
7,472,568 B2 * 1/2009 Tang ..... 70/39
7,624,606 B1 * 12/2009 Huang et al. ..... 70/338
7,634,931 B2 * 12/2009 Segien et al. ..... 70/384

(Continued)

*Primary Examiner* — Suzanne Barrett
(74) *Attorney, Agent, or Firm* — Loeb & Loeb LLP

(57) ABSTRACT

A lock includes a shackle having a short first portion, a long second portion and a curved portion. The second portion has a groove defined in outside thereof. A body has a first hole and a second hole for receiving the first and second portions respectively. A passage is defined in outside of the body and perpendicularly communicates with the second hole. A positioning unit is located in the passage and has a securing member, a pin and a resilient member. The securing member has a path in which a narrowed section of the pin is inserted. The resilient member biases the pin which is engaged with the groove. When the pin is moved to compress the resilient member, the pin is removed from the groove and the narrowed section is located corresponding to the groove so that the second portion can be removed from the second hole.

3 Claims, 8 Drawing Sheets

(56) References Cited

U.S. PATENT DOCUMENTS 7,802,455 B2 * 9/2010 Herdman ..... 70/493
7,856,855 B2 * 12/2010 Fantl et al. ..... 70/39
8,096,151 B2 * 1/2012 Cheevers et al. ..... 70/38 A
8,234,896 B2 * 8/2012 Uliano ..... 70/371
2004/0194516 A1 * 10/2004 Chen ..... 70/54

* cited by examiner

LOCK WITH REPLACEABLE SHACKLE

FIELD OF THE INVENTION

The present invention relates to a lock, and more particularly, to a lock with a replaceable shackle.

BACKGROUND OF THE INVENTION

The conventional padlock generally comprises a body with a core received in a space defined therein, and a shackle is connected to the body. The shackle includes a first portion, a second portion and a curved portion which is connected between the first and second portions, wherein the first portion is shorter than the second portion. A first hole for receiving the first portion, and a second hole for receiving the second portion is defined in the top of the body. A room is defined in the body and communicates with first hole. A threaded hole is defined from outside of the body and communicates with the second hole perpendicularly. The threaded hole has inner threads with which a bolt is threadedly connected. The bolt is a hexagonal bolt.

The core is located in the space and has a cam which is driven by a key, the cam is located corresponding to the room.

The second portion of the shackle has a groove and the first portion has a notch.

When the padlock is in locked status, the cam is located in the room and engaged with the notch so that the first portion cannot be removed from the first hole. When unlocking the padlock, the key is used to rotate the cam so that the cam is disengaged from the notch of the first portion of the shackle, and the first portion can be pulled out from the first hole. The bolt has one end thereof to seal the threaded hole and the other end of the bolt is engaged with the groove of the second portion, so that the second portion cannot be removed from the second hole. In other words, when replacing the shackle, the user has to remove the bolt from the body by using a specific tool to remove the hexagonal bolt. For safety concern, the bolt is designed to be connected to the threaded hole in only one direction, and cannot be removed in the opposite direction so that the bolt cannot be easily removed from the body and the replacement of the shackle becomes difficult.

The present invention intends to provide a lock whose shackle is easily replaced.

SUMMARY OF THE INVENTION

The present invention relates to a lock and comprises a shackle having a first portion, a second portion and a curved portion which is connected between the first and second portions. The first portion is shorter than the second portion which has a groove defined in outside thereof. A body has a first hole and a second hole, and the first portion is located in the first hole and the second portion is located in the second hole. A passage is defined in outside of the body and perpendicularly communicates with the second hole. A positioning unit is located in the passage and has a securing member, a pin and a resilient member. The securing member has a path defined therethrough and is located at the opening of the passage. The pin has a narrowed section which is inserted into the path of the securing member. The resilient member biases the pin. The pin is engaged with the groove. When the pin is moved to compress the resilient member, the pin is removed from the groove and the narrowed section is located corresponding to the groove so as to allow the second portion to be removed from the second hole.

Preferably, the securing member has outer threads and the passage has inner threads defined therein. The outer threads of the securing member are threadedly connected to the inner threads in one direction so as to seal the opening of the passage.

Preferably, the body has a space and a room which communicates with the space. A core is located in the space and has a lock hole in the first end thereof. A cam is located at the second end of the core and located in the room. Two engaging recesses are defined in two sides of the cam respectively. The room communicates with the first and second holes. Two beads are located in the first and second holes. The first and second portions each have a notch. The two beads are located corresponding to the two notches of the first and second portions.

The primary object of the present invention is to provide a lock having the positioning unit. When replacing the shackle, the lock is unlocked and the pin is applied by a force so as to move the pin to compress the resilient member to remove the pin from the groove in the second portion of the shackle. The narrowed section of the pin is located corresponding to the groove of the second portion so that the second portion can be completely removed from the second hole of the body. When the second portion of the new shackle is inserted into the second hole, the pin is released which is moved back to its initial position by the resilient member, and the narrowed section is engaged with the groove of the new shackle. The present invention allows the user to replace a new shackle of different material and length easily.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
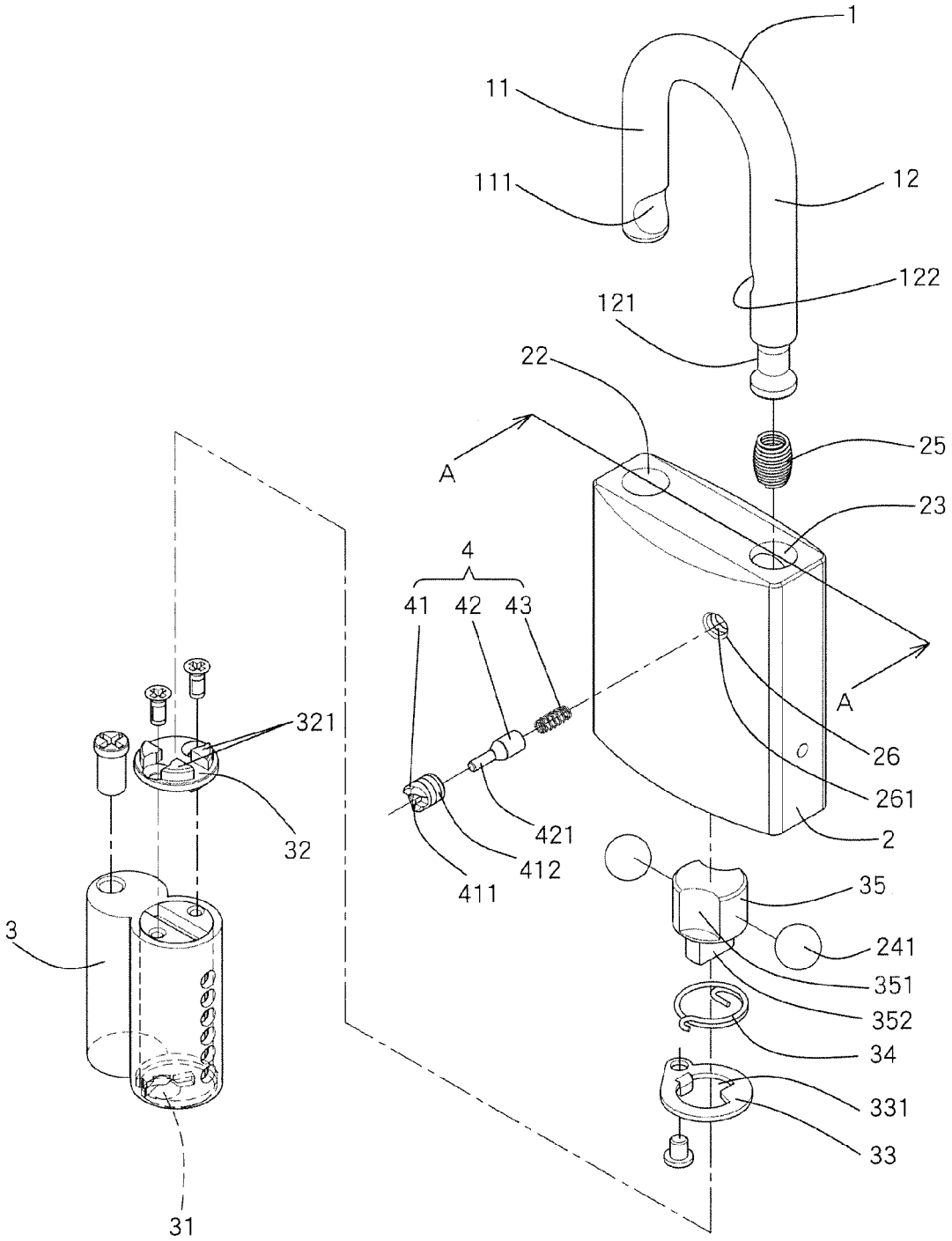
FIG. 1 is an exploded view to show the lock of the present invention.
Figure 2:
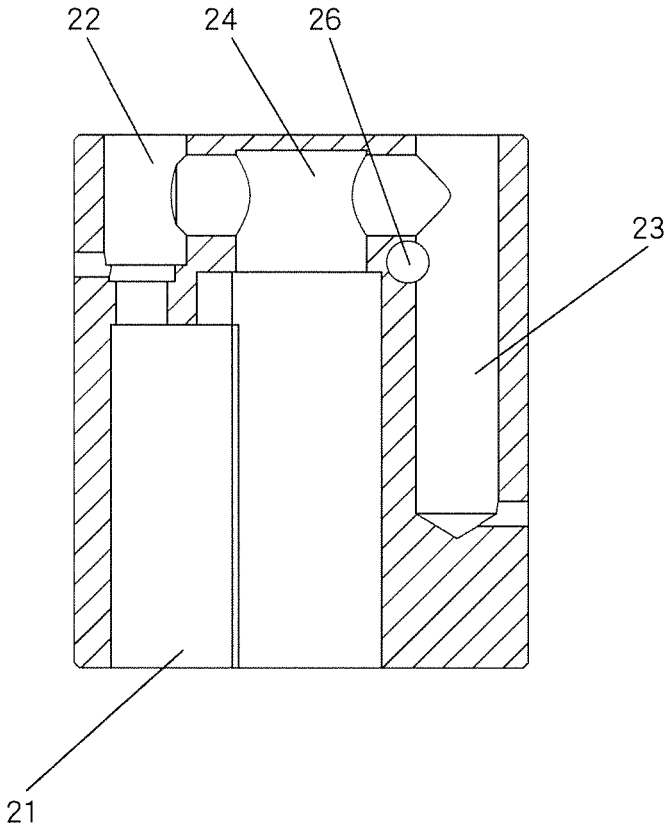
FIG. 2 is a cross sectional view, taken along line A-A of the body of the lock of the present invention.
Figure 3:
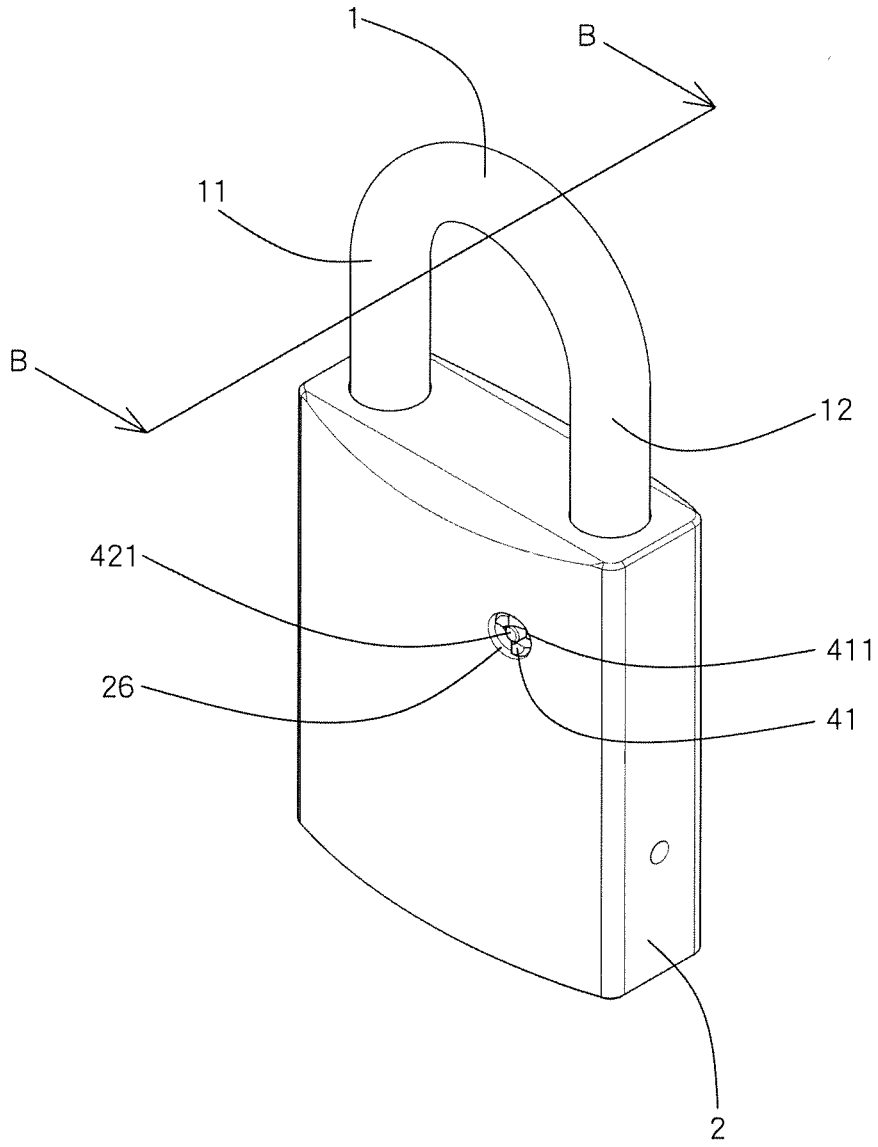
FIG. 3 is a perspective view to show the lock of the present invention.

Referring to FIGS. 1 to 4, the lock of the present invention comprises a shackle 1 having a first portion 11, a second portion 12 and a curved portion which is connected between the first and second portions 11, 12. The first portion 11 is shorter than the second portion 12. The second portion 12 has a groove 121 defined in outside thereof. The first and second portions 11, 12 each have a notch 111, 122.

A body 2 has a space 21 defined therein which is drilled from the underside of the body 2. A first hole 22 and a second hole 23 are defined in the top of the body 2. A room 24 is defined in the body 2 and located above the space 21. The room 24 communicates with the space 21, the first hole 22 and the second hole 23. A core 3 is located in the space 21 and has a lock hole 31 in the first end thereof. A first positioning member 32, a second positioning member 33, a connection member 34 and a cam 35 are connected to the second end of the core 3. The first positioning member 32 is connected to the core 3 and has multiple protrusions 321. The second positioning member 33 has a through hole 331. The cam 35 is located in the room 24 and two engaging recesses 351 are defined in two sides of the cam 35 respectively. The cam 35 further has a block 352 to which the connection member 34 is mounted. The block 352 is engaged between the protrusions 321 via the through hole 331. The first hole 22 receives the first portion 11 and the second hole 23 receives a resilient part 25 and the second portion 12. A passage 26 is defined in the outside of the body 2 and perpendicularly communicates with the second hole 23. The two beads 241 are received in the room 24 and located corresponding to the two notches 111, 122 of the first and second portions 11, 12.

The positioning unit 4 is located in the passage 26 and has a securing member 41, a pin 42 and a resilient member 43, wherein the securing member 41 has a path 411 defined therethrough and is located at the opening of the passage 26. The securing member 41 has outer threads 412 and the passage 26 has inner threads 261 defined therein, the outer threads 412 of the securing member 41 are threadedly connected to the inner threads 261 in one direction so as to seal the opening of the passage 26. The pin 42 has a narrowed section 421 extending from the first end thereof, the narrowed section 421 inserted in the path 411 of the securing member 41. The resilient member 43 biases the second end of the pin 42, and the pin 42 is engaged with the groove 121.

It is noted that the outer threads 412 of the securing member 41 can only be threadedly connected to the inner threads 261 of the passage 26 in one direction. Once the securing member 41 is connected to the passage 26, it cannot be removed from the passage 26 by rotating the securing member 41 in opposite direction.

Figure 4:
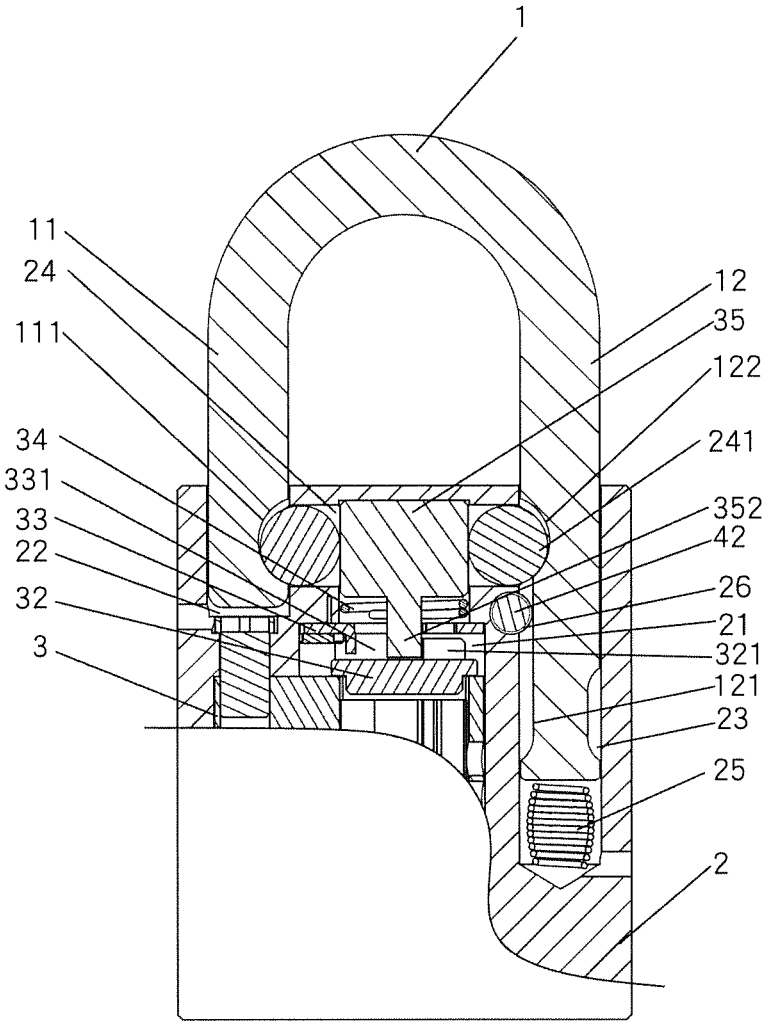
FIG. 4 is a cross sectional view to show the locked status of the lock of the present invention.
Figure 5:
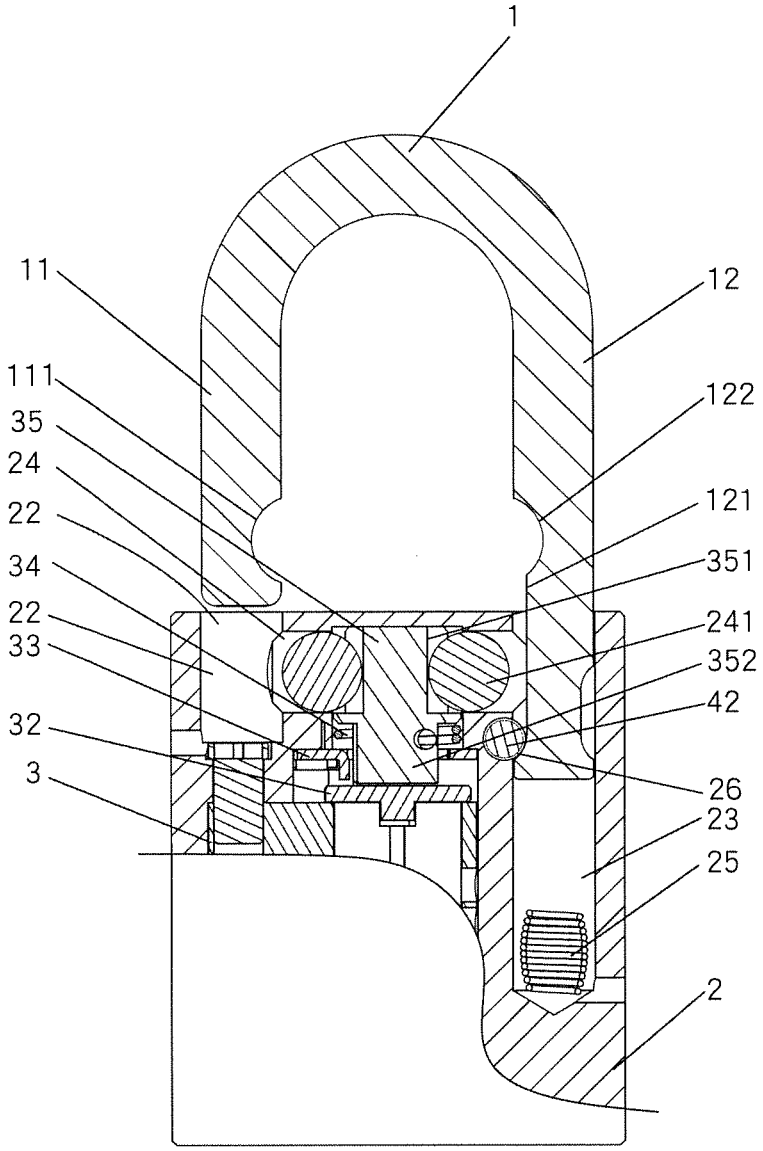
FIG. 5 is a cross sectional view to show the unlocked status of the lock of the present invention.

As shown in FIG. 4, when the lock is in locked status, the beads 241 are engaged with the notches 111, 122 of the first and second portions 11, 12. The first and second portions 11, 12 are respectively inserted into the first and second holes 22, 23. The cam 35 is rotated to the position such that the beads 241 are engaged with the notches 111, 122 of the first and second portions 11, 12. In other words, when rotating the cam 35, the side that has no engaging recess 351 contacts the beads 241 to position the beads 241 in the two notches 111, 122. The first and second portions 11, 12 are stopped by the beads 241 so that the shackle 1 cannot be pulled out from the body 2, this is the locked status. When the lock is in the unlocked status as shown in FIG. 5, the cam 35 is rotated to the position where the two beads 241 are located corresponding to the engaging recesses 351, so that the beads 241 are able to be located in the engaging recesses 351, and the shackle 1 can be pulled upward until the first portion 11 is completely removed from the first hole 22. The second portion 12 is stopped by the pin 42 and cannot be separated from the second hole 23.

Figure 6:
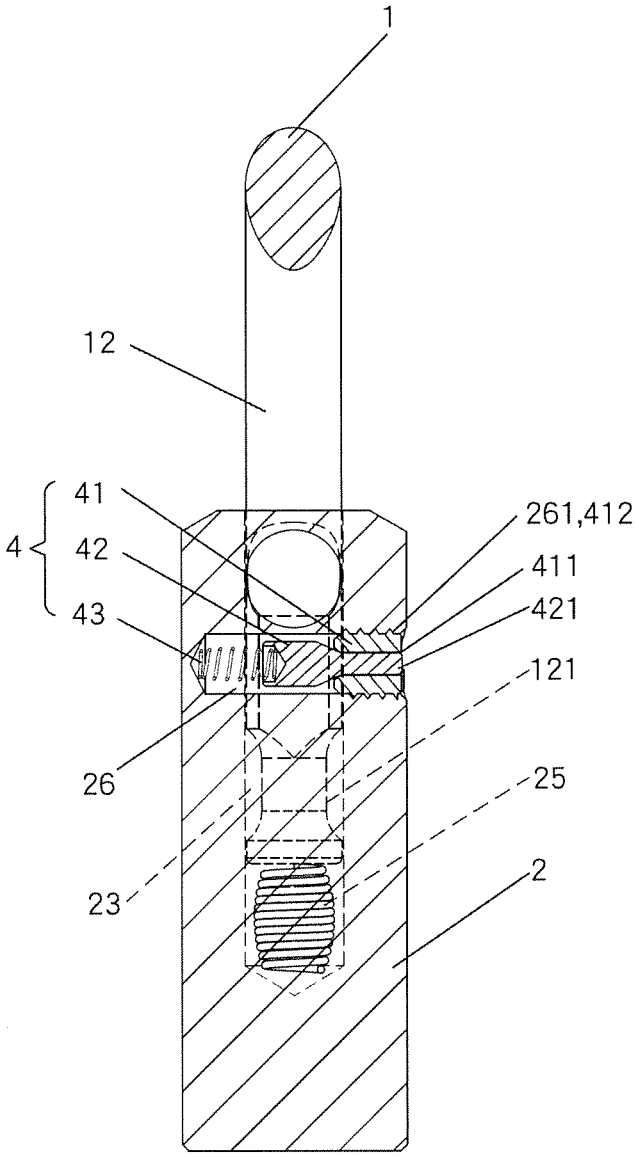
FIG. 6 is a cross sectional view, taken along line B-B in FIG. 3.
Figure 7:
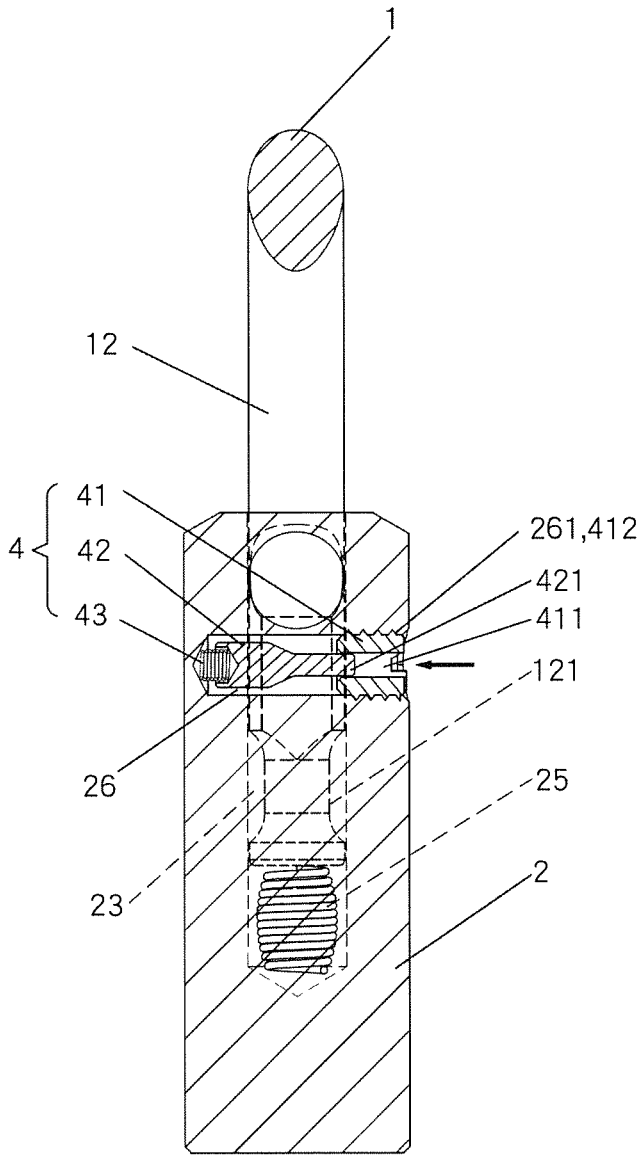
FIG. 7 shows the movement of the pin of the lock of the present invention.
Figure 8:
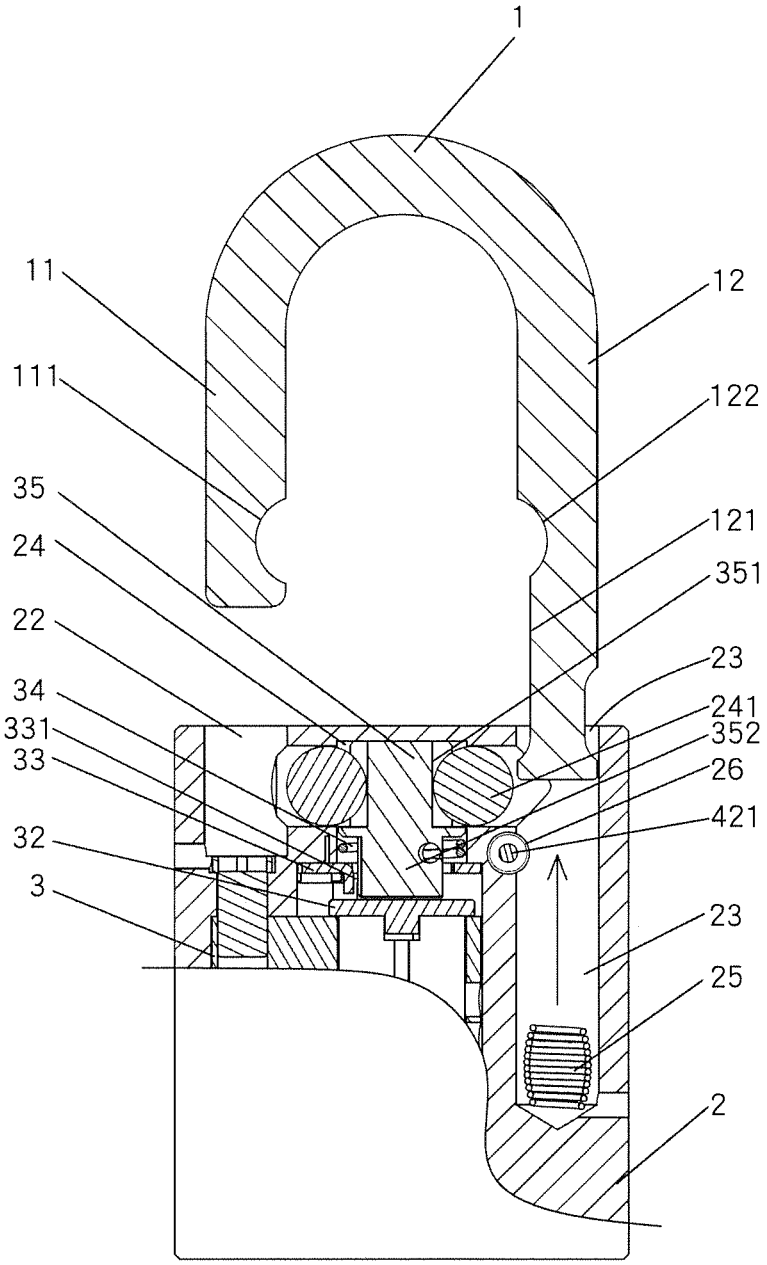
FIG. 8 is a cross sectional view to show the replacement of the shackle when the lock is unlocked.

When replacing the shackle 1, as shown in FIGS. 6 to 8, the core 3 of the lock is in the unlocked status, the user uses a tool with a tip such as paper clip to push the end face of the narrowed section 421 by the tip of the tool. The pin 42 is moved to compress the resilient member 43. The pin 42 is removed from the groove 121 and the narrowed section 421 is located corresponding to the groove 121 so as to allow the second portion 12 to be removed from the second hole 23 and does not stopped by the pin 42. When the lock is in unlocked status, the beads 241 are located in the engaging recesses 351 of the cam 35 so that the second portion 12 is not stopped by the bead 241 corresponding thereto and the pin 42 does not contact the second portion 12. The shackle 1 can be completely separated from the body 2 by removing the second portion 12 from the second hole 23. After a new shackle is inserted into the first and second holes 11, 12, the user removes the force applied to the pin 42, the resilient member 43 pushes the pin 42 back to its initial position. The new shackle is then positioned by the pin 42 and does not drop from the body 2.

By the positioning unit 4 and the second hole 23 perpendicularly communicating with the engaging recesses 351, when replacing the shackle 1, the lock is unlocked and the pin 42 is movably in the path 411 of the securing member 41, the narrowed section 421 is moved to be located corresponding to the groove 121 of the second portion 12 so that the second portion 12 can be completely removed from the second hole 23 of the body 2 and does not stopped by the pin 42. The present invention allows the user to replace a new shackle of different material and length easily.

While we have shown and described the embodiment in accordance with the present invention, it should be clear to those skilled in the art that further embodiments may be made without departing from the scope of the present invention.

What is claimed is:

1. A lock comprising:

a shackle having a first portion, a second portion and a curved portion which is connected between the first and second portions, the first portion being shorter than the second portion, the second portion having a groove defined outside thereof;

a body having a first hole and a second hole, the first portion located in the first hole and the second portion located in the second hole;

a passage defined in the body, extending to an outer surface of the body and perpendicularly communicating with the second hole; and a positioning unit located in the passage and having a securing member, a pin and a resilient member, the securing member having a path defined therethrough and being located at an opening of the passage, the pin having a narrowed section extending from a first end thereof, the narrowed section inserted in the path of the securing member, the resilient member biasing a second end of the pin, the pin engaged with the groove, when the pin being moved to compress the resilient member, the pin is removed from the groove and the narrowed section is located corresponding to the groove so as to allow the second portion to be removed from the second hole.

2. The lock as claimed in claim 1, wherein the securing member has outer threads and the passage has inner threads defined therein, the outer threads of the securing member are threadedly connected to the inner threads in one direction so as to seal the opening of the passage.

3. The lock as claimed in claim 1, wherein the body has a space and a room which communicates with the space, a core is located in the space and has a lock hole in a first end thereof, a cam is located at a second end of the core, the cam is located in the room, two engaging recesses are defined in two sides of the cam respectively, the room communicates with the first and second holes, two beads are located in the room, the first and second portions each have a notch, the two beads are located corresponding to the two notches of the first and second portions.

* * * * *